US008202126B2

(12) United States Patent
Lim

(10) Patent No.: US 8,202,126 B2
(45) Date of Patent: Jun. 19, 2012

(54) CONNECTOR

(75) Inventor: Chin Hua Lim, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/741,938

(22) PCT Filed: Oct. 27, 2008

(86) PCT No.: PCT/US2008/081355

§ 371 (c)(1), (2), (4) Date: May 7, 2010

(87) PCT Pub. No.: WO2009/061630

PCT Pub. Date: May 14, 2009

(65) Prior Publication Data

US 2010/0248549 A1 Sep. 30, 2010

(30) Foreign Application Priority Data

Nov. 7, 2007 (SG) ..... 200717559

(51) Int. Cl.
*H01R 24/00* (2011.01)

(52) U.S. Cl. ..... 439/636; 439/607.31

(58) Field of Classification Search ..... 439/83, 439/630, 636, 607.31–607.33, 607.4
See application file for complete search history.

(56) References Cited

U.S. PATENT DOCUMENTS

| | | | |
|---|---|---|---|
| 4,878,858 | A | 11/1989 | Dechelette |
| 5,746,622 | A | 5/1998 | Consoli |
| 5,842,883 | A | 12/1998 | Igarashi |
| 5,863,210 | A | 1/1999 | Reisinger |
| 5,904,586 | A | 5/1999 | Takayasu |
| 6,086,429 | A | 7/2000 | Wu |
| 6,203,345 | B1 | 3/2001 | Roque |
| 6,227,877 | B1 | 5/2001 | Mou et al. |
| 6,227,907 | B1 | 5/2001 | Wu |
| 6,402,554 | B1 | 6/2002 | Yeh |
| 6,726,499 | B1 | 4/2004 | Yu |
| 7,018,238 | B1 | 3/2006 | Zhi-xuan |
| 7,086,895 | B1 | 8/2006 | Ting |
| 7,238,048 | B2 | 7/2007 | Olson et al. |

(Continued)

FOREIGN PATENT DOCUMENTS

DE 19815016 3/2000

OTHER PUBLICATIONS

Search Report for International Application No. PCT/US2008/081355, 4 pgs.

(Continued)

*Primary Examiner* — Khiem Nguyen
(74) *Attorney, Agent, or Firm* — Robert S. Moshrefzadeh

(57) ABSTRACT

A connector comprising an insulative housing that has a top, a bottom, a first side, a second side wherein all four sides are connected to form a mating face and a board-mounting end; a plurality of terminals supported in the housing and terminating at the board-mounting end wherein each terminal further comprises a contact portion configured to establish electrical contact with a complementary mating connector, a solder tail that extends out of the housing at the board-mounting end, a body portion that is disposed intermediate the contact portion and the solder tail and which interconnect them together; and at least one solder bracket coupled to the housing wherein a major portion of the solder bracket lies within the profile of the housing.

10 Claims, 10 Drawing Sheets

U.S. PATENT DOCUMENTS

| | | | |
|---|---|---|---|
| 7,517,232 | B2 | 4/2009 | Yuan et al. |
| 7,588,445 | B2 | 9/2009 | He et al. |
| 7,591,683 | B2 | 9/2009 | Zhang et al. |
| 7,686,628 | B2 | 3/2010 | Lino et al. |
| 2004/0166711 | A1 | 8/2004 | Uchida |
| 2006/0009080 | A1 | 1/2006 | Regnier |
| 2006/0014438 | A1 | 1/2006 | Regnier |
| 2006/0040556 | A1 | 2/2006 | Neer |

OTHER PUBLICATIONS

Search Report for International Application No. PCT/US2008/081361, 4 pgs.

Search Report for Singapore Patent Application No. 2007/17559-9, 4 pgs.

Search Report for Singapore Patent Application No. 200717558-1, 3 pgs.

Written Opinion for International Application No. PCT/US2008/081355, 7 pgs.

Written Opinion for International Application No. PCT/US2008/081361, 7 pgs.

Written Opinion for Singapore Patent Application No. 200717558-1, 5 pgs.

Written Opinion—Second for Singapore Patent Application No. 2007/17558-1, 7 pgs.

CONNECTOR

CROSS REFERENCE TO RELATED APPLICATIONS

This application is a national stage filing under 35 U.S.C. 371 of PCT/US2008/081355, filed Oct. 27, 2008, which claims priority to Singapore Application No. 200717559-9, filed Nov. 7, 2007, the disclosure of which is incorporated by reference in its/their entirety herein.

TECHNICAL FIELD

The present invention relates to the art of connectors and, particularly to an electrical connector adapted for mounting on a printed circuit board.

BACKGROUND

A printed circuit board (PCB) connector (e.g. a receptacle) may be directly soldered (also known as surface mounting) to a surface of the PCB to provide a connectable interface between the PCB and another device with an opposing mating connector (e.g. a plug).

A surface mount receptacle typically includes a housing with a mating face for mating with an opposing mating plug and a board-mounting end from which a plurality of terminals exit the housing for termination to circuit traces on the PCB. The surface mount receptacle may further include a plurality of mounting posts at the base of the housing for the purpose of aiding the alignment of the surface mount receptacle to the PCB during mounting.

The terminals normally include mating portions for mating with the terminals of the opposing mating plug and tail portions (or 'solder tails') projecting from the housing for interconnection, as by soldering, to circuit traces on the PCB or in holes in the PCB into which the tails are inserted. The solder tails when soldered to the PCB often become the only points of attachment and the only means of securing the surface mount receptacle onto the PCB other than the mounting posts.

A common practice to connect cables to a PCB is by terminating the cables at a plug connector (jointly referred to as cable assembly) and then mating the plug connector to a surface mount receptacle on the PCB. The plug connector typically includes a printed circuit card that has a projecting edge that is received within a mating slot in the surface mount receptacle.

High speed data transfer systems require electrical connectors in which the electrical impedance can be controlled in order to maintain the required data transfer rate of the electrical system. Shielding cages are typically utilised with such connectors to control the emission of electromagnetic interference. These cages often serve as a secondary housing for the connector in that they will substantially enclose the connectors. U.S. Publ No. 2006/0040556 discloses one such shield housing.

With the miniaturisation of electronic equipment, small-sized surface mount receptacles with very fine solder tails are desired because the footprint allocated for each internal component is reduced to accommodate the limited internal space within the electronic equipment. U.S. Publ. No. 2006/0009080 and U.S. Publ No. 2006/0014438 disclose one such surface mount receptacle.

The small size of the surface mount receptacle makes it difficult to guide the opposing mating plug into mating with the surface mount receptacle as well as increases the difficulty of ensuring the opposing mating plug mates properly with the surface mount receptacle, especially in a blind mating application.

Because the solder contacts at the solder tails are the only means of attachment between the surface mount receptacle and the PCB other than the mounting posts, any failed attempt in aligning and mating the opposing mating plug to the surface mount receptacle can cause mechanical stress at these points of attachment causing the solder contacts to loosen and ultimately breaking signal pathways and causing connection to the PCB to fail. In addition, the repeated unsuccessful engagement of the opposing mating plug with the surface mount receptacle together with the cable's weight and movement can cause the surface mount receptacle to lift off the PCB, further stressing and breaking the points of attachment.

The present invention is directed at preventing the breakage of signal pathways due to the lifting of the surface mount receptacle by providing an improved structure for anchoring and holding the receptacle to a PCB without substantially increasing the footprint required to mount the receptacle.

SUMMARY

It would be desirable to provide a connector with an improved structure that can hold the connector to a printed circuit board without increasing the footprint required to mount the connector.

In accordance with one embodiment of the present invention, there is provided a connector, comprising:

an insulative housing that has a top, a bottom, a first side, a second side wherein all four sides are connected to form a mating face and a board-mounting end;

a plurality of terminals supported in the housing and terminating at the board-mounting end wherein each terminal further comprises a contact portion configured to establish electrical contact with a complementary mating connector, a solder tail that extends out of the housing at the board-mounting end, a body portion that is disposed intermediate the contact portion and the solder tail and which interconnect them together; and at least one solder bracket coupled to the housing wherein a major portion of the solder bracket lies within the profile of the housing.

In accordance with another embodiment of the present invention, there is provided an electrical connector configured to be mounted on a printed circuit board comprising:

an insulative housing that has a top, a bottom, a first side, a second side, all four sides connected to form a mating face and a board-mounting end wherein at the mating face, there is at least one mating slot extending into the housing;

a plurality of terminals supported in the housing and terminating at the board-mounting end wherein the terminals are grouped into a first set and a second set and each terminal in the first set and the second set further comprises a contact portion that extends into the mating slot, a solder tail that extends out of the housing at the board-mounting end, a body portion that is disposed intermediate the contact portion and the solder tail and which interconnect them together; and at least one solder bracket coupled to the housing wherein a major portion of the solder bracket lies within the profile of the housing.

BRIEF DESCRIPTION OF THE DRAWINGS

An exemplary form of the present invention will now be described with reference to the accompanying drawings in which.

While the above-identified figures set forth several embodiments of the invention, other embodiments are also contemplated, as noted in the detailed description. In all cases, this disclosure presents aspects of the invention by way of representation and not limitation. It should be understood that numerous other modifications and embodiments can be devised by those skilled in the art, which fall within the scope and spirit of the principles of the invention. The figures may not be drawn to scale. Like reference numbers have been used throughout the figures to denote like parts.

DETAILED DESCRIPTION

Figure 1:
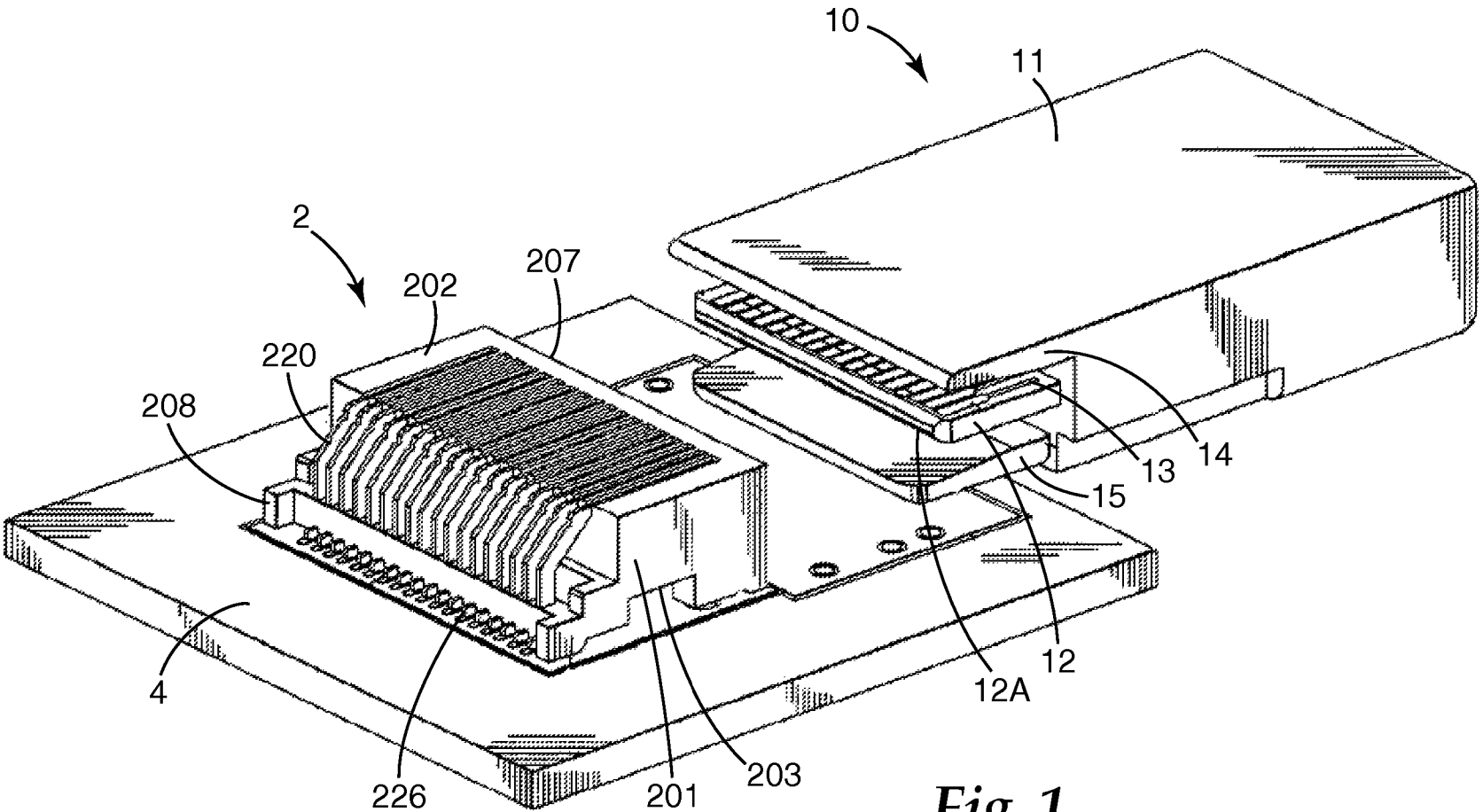
Fig. 1 PRIOR ART
FIG. 1 shows a perspective view of a commercially available opposing mating plug aligned to mate with a prior art surface mount receptacle mounted on a printed circuit board, the wires of the opposing mating plug having been removed for clarity.
Figure 3A:
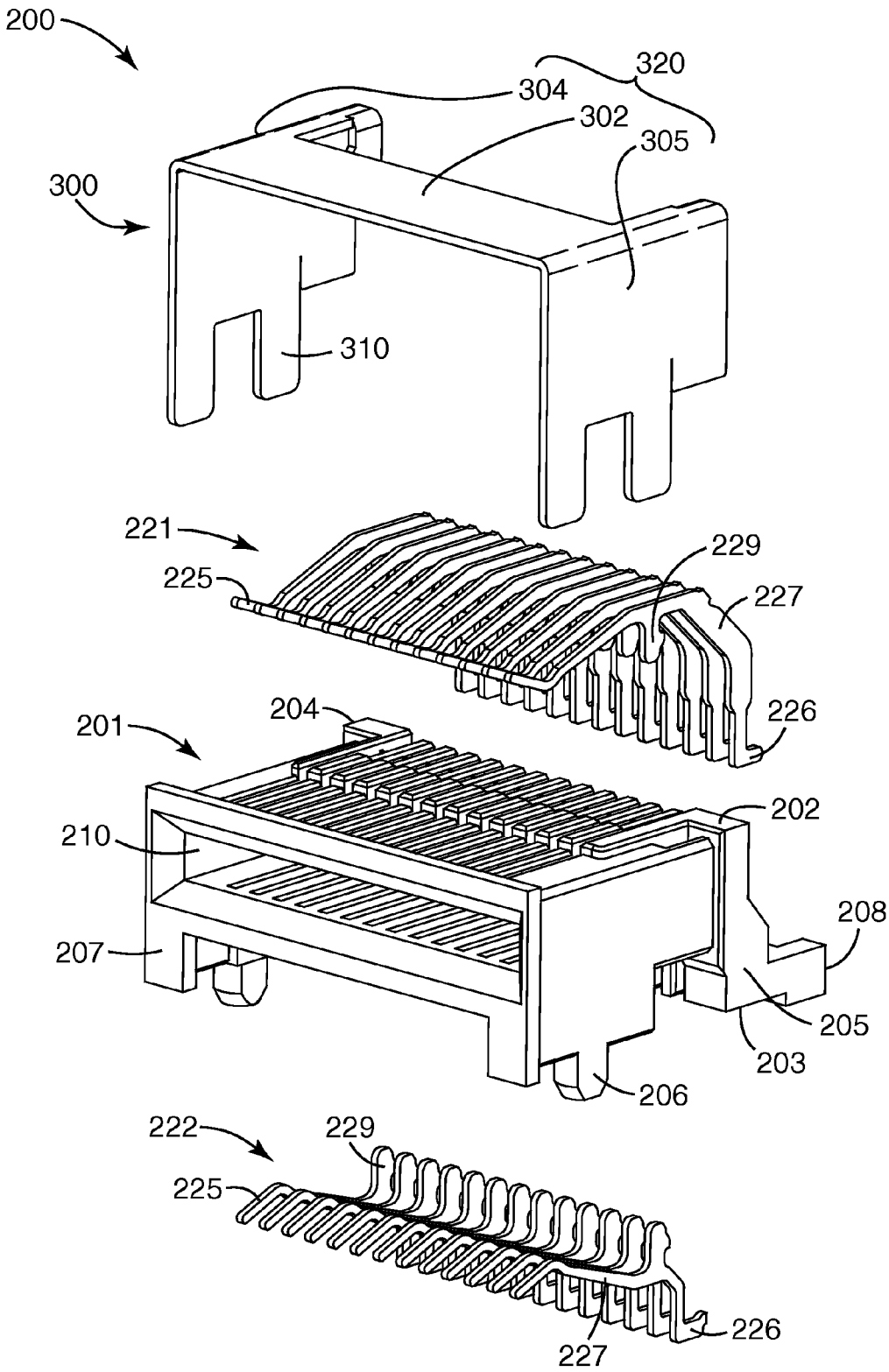
FIG. 3A is an exploded perspective view of an exemplary connector of the present invention.

FIG. 1 shows a prior art plug connector 10 aligned and ready to mate with a receptacle connector 2 that is mounted by soldering on a printed circuit board 4. The receptacle connector 2 comprises a housing 201 with a top 202, a bottom 203, a mating face 207, a board-mounting end 208 and a plurality of terminals 220 grouped into a first set 221 and a second set 222 (as shown in FIG. 3A) supported in the housing 201 of the receptacle connector 2.

Figure 2A:
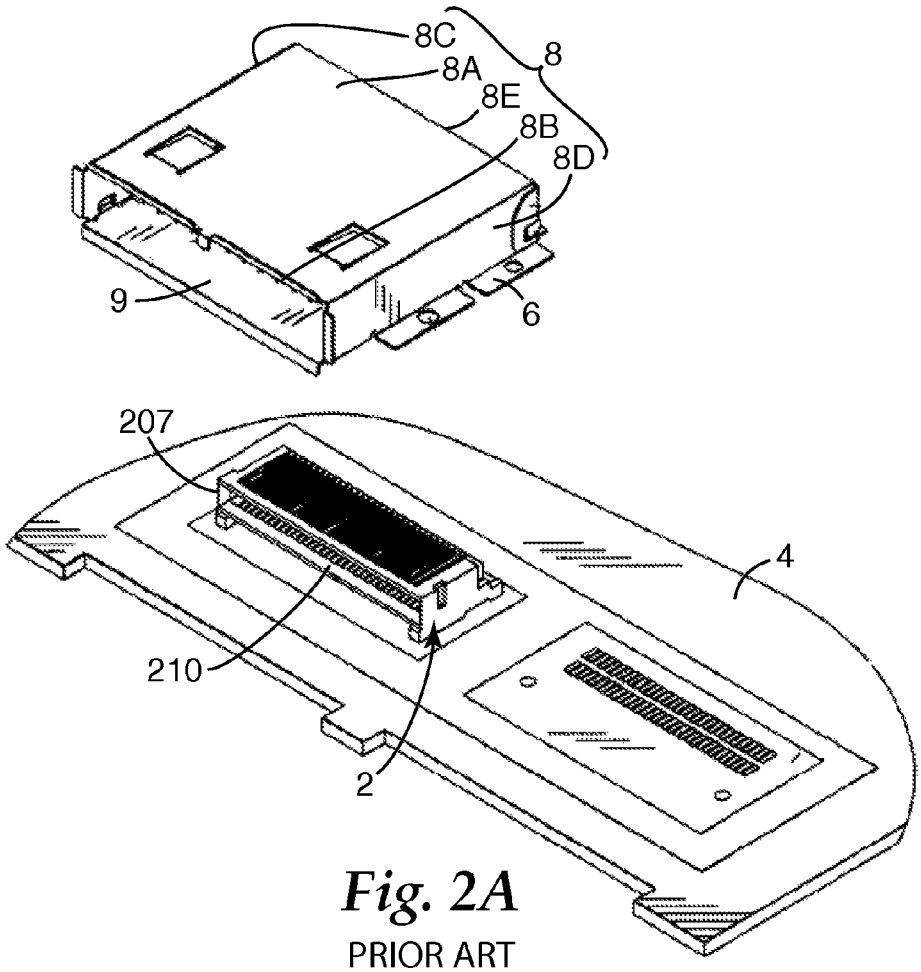
Fig. 2A PRIOR ART
FIG. 2A shows a prior art circuit board with two arrangements of conductive contact pads disposed thereon and with a surface mount receptacle mounted to one of the two contact pad arrangements and a shield housing cum guide aligned to enclose the surface mount receptacle.

The plug connector 10 has an insulative plug housing 11 into which a plurality of wires or cables (not shown) are fed and the wires or cables thereof terminate at a plurality of conductive traces 13 or contact pads disposed on two major surfaces of a circuit card 12. The circuit card 12 has a forward edge 12A that is received within a mating slot 210 (as shown in FIG. 2A) provided at the mating face 207 of the housing 201 of the receptacle connector 2 when the two connectors mate. The plug housing 11 includes an upper flange 14 and a lower flange 15, both flanges 14, 15 spaced apart from each other thereby defining an intervening space that surrounds or encloses the projection portion of the circuit card 12. During mating, the lower flange 15 of the plug connector 10 is received within a cavity or recess beneath the mating slot 210 of the receptacle connector 2 and between two side walls thereof. Both the upper and lower flanges 14, 15 which are formed from an insulative material extend for a defined distance over the first set 221 and the second set 222 of terminals to prevent electrostatic discharges from occurring during the mating of the two connectors.

Figure 2B:
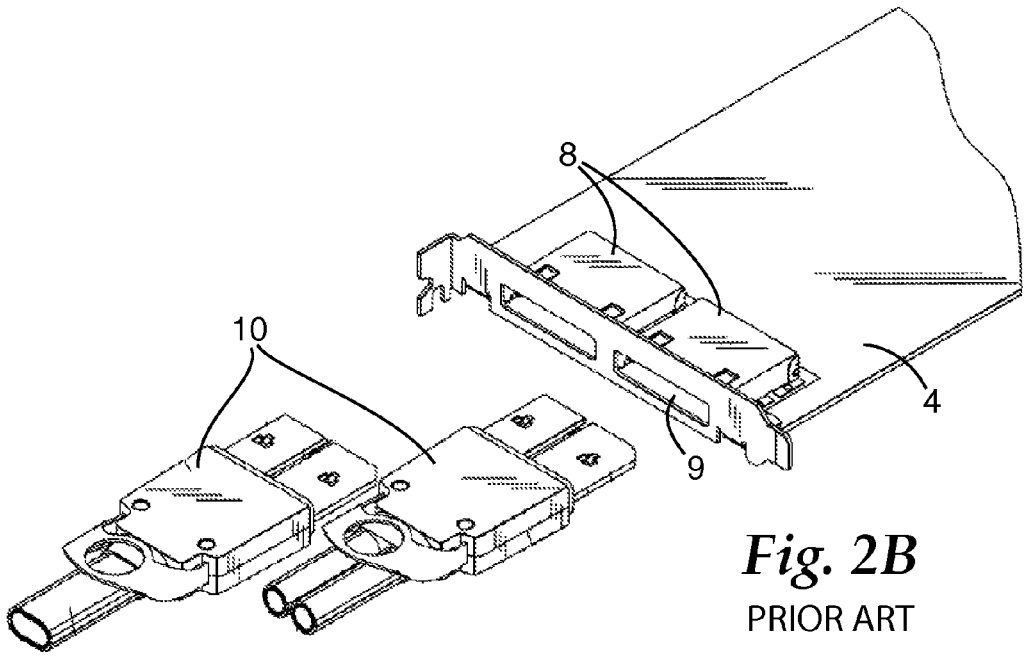
Fig. 2B PRIOR ART
FIG. 2B shows the circuit board of FIG. 2A with two surface mount receptacles enclosed within two shield housing cum guides mounted on the circuit board and with two opposing mating plug connectors aligned to mate with their respective surface mount receptacles.

FIG. 2A shows a prior art shield housing 8 formed from a sheet metal blank through a suitable process, such as a stamping and forming process. The shield housing comprises a top wall 8A, two side walls 8C, 8D, a back wall 8E and a bottom wall 8B, all combined to collectively define a bottom opening (not shown) that leads to a hollow interior cavity while the top wall 8A, two side walls 8C, 8D and bottom wall 8B cooperate to define an entrance 9 that leads to the hollow interior cavity. The shield housing 8 further comprises a series of flanges 6 formed along the side walls 8C, 8D that are bent at an angle to provide a mounting surface for attachment to the PCB 4. The shield housing 8 when mounted on the PCB 4 encloses the receptacle connector 2 and provides a shield for the receptacle connector 2 and the plug connector 10 against electromagnetic interference. FIG. 2B shows a plurality of plug connectors 10 aligned and ready to mate with a plurality of receptacle connectors 2 shielded by their respective shield housings 8.

As the shield housing 8 extends beyond the footprint of the receptacle connector 2, it takes up valuable real estate on the PCB 4 which is a limited resource especially for small electronic equipment. In addition, due to the shield housing 8 enclosing the receptacle connector 2 beyond its mating face 207, it is difficult to accurately mate the plug connector 10 with the receptacle connector 2 thereby increasing the chances of a mating failure and increasing the number of times needed to correctly couple the two connectors.

Referring to FIG. 1, the receptacle connector 2 is attached to the PCB 4 via a plurality of solder tails 226. As the solder tails 226 for a small receptacle connector are very fine, the solder contact at the points of attachment where the solder tails 226 of the receptacle connector 2 are soldered to the PCB 4 is limited. For every mating failure that occurred, mechanical stress can be generated at the points of attachment. Repeated mechanical stress at the points of attachment can cause the solder contact to loosen and the receptacle connector 2 to lift off the PCB 4 resulting in a breakage of the signal pathways thereby causing the connection to the PCB 4 to fail.

The present invention is directed at preventing the breakage of signal pathways due to the lifting of the receptacle connector by providing an improved structure for anchoring and holding the receptacle connector to a PCB without substantially increasing the footprint required to mount the receptacle connector.

Figure 3B:
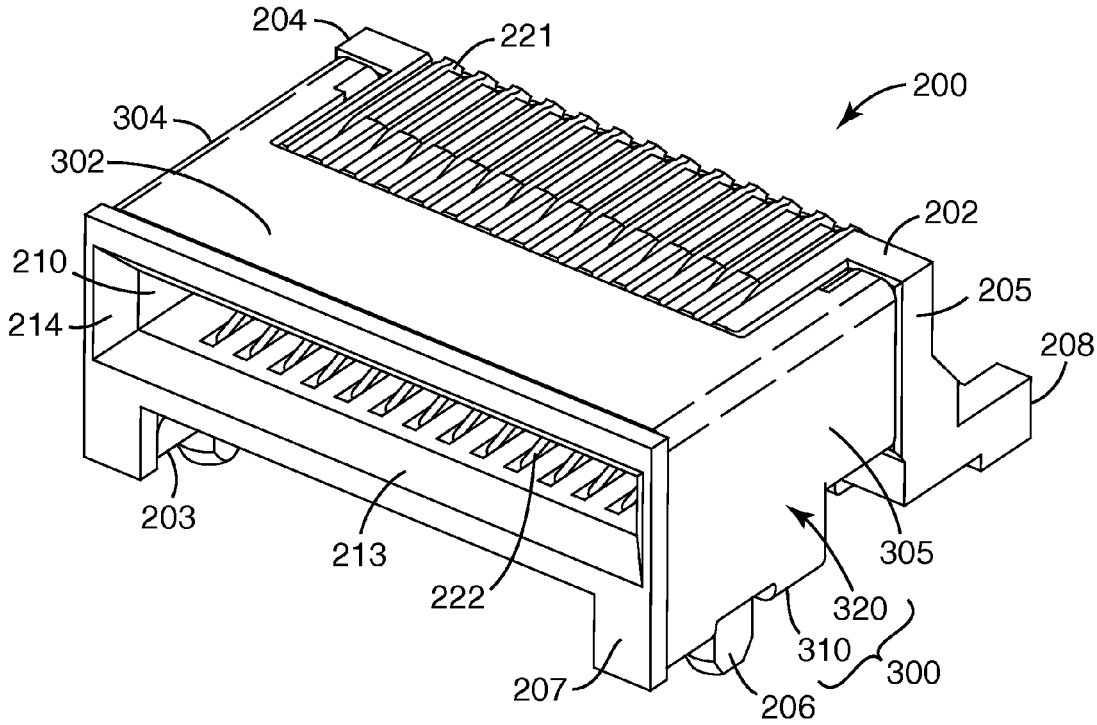
FIG. 3B is a perspective view of the assembled exemplary connector of FIG. 3A.

Referring to FIGS. 3A and 3B, an exemplary connector 200 in accordance with the present invention comprises an insulative housing 201 that has a top 202, a bottom 203, a first side 204, a second side 205, all four sides connected to form a mating face 207 and a board-mounting end 208; a first set 221 and a second set 222 of terminals supported in the housing 201 and terminating at the board-mounting end 208 and at least one solder bracket 300 coupled to the housing 201. The housing 201 may further comprise a plurality of mounting posts 206 at the bottom 203 which may be used for positioning the connector 200 on the PCB 4.

Figure 4:
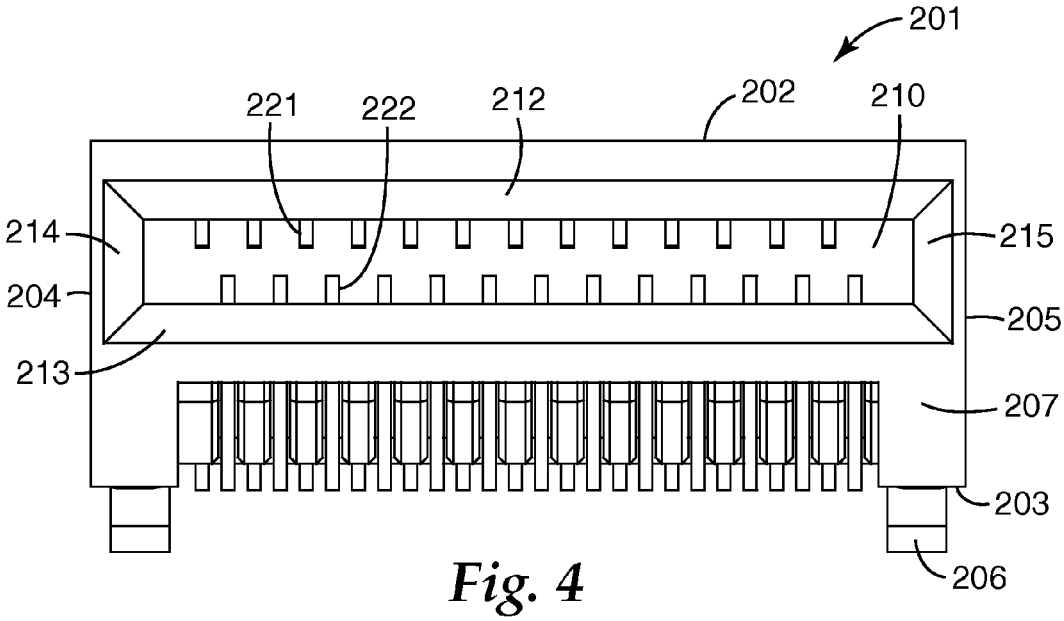
FIG. 4 is a front view of a housing of the exemplary connector of FIG. 3B looking towards a mating face of the housing.

Referring to FIG. 4, in one embodiment of the present invention, at the mating face 207 of the housing 201, there is a mating slot 210 which receives the plug connector 10 of a cable assembly 11 when the plug connector 10 mates with the connector 200; wherein the mating slot 210 bounded by a top wall 212, a bottom wall 213, two side walls 214, 215 and a rear wall (not shown) extends into the interior of the housing 201.

It should be noted that the arrangement of the two connectors in this description (i.e. a receptacle connector on the PCB and a plug connector at an end of a cable assembly) has been presented for the purpose of illustration and description. It is not intended to be exhaustive or to limit the invention to the precise forms disclosed, since many modifications or variations (e.g. a plug connector on the PCB and a receptacle connector at an end of a cable assembly) thereof are possible in light of the above teaching. All such modifications and variations are within the scope of the invention.

The first set of terminals 221 and the second set of terminals 222 extend into the mating slot 210 and provide an electrical transmission path from the cable assembly 11 to the PCB 4. The first set of terminals 221 is similar to the second set of terminals 222 in that each terminal in the two sets further comprises a contact portion 225 that extends into the mating slot 210 and a solder tail 226 that extends out of the housing 201 for attachment to the PCB 4 on which the connector 200 is to be mounted. Each terminal also includes a body portion 227 that is disposed intermediate the contact portion 225 and the solder tail 226 and which interconnect them. Each terminal may further comprise a retention portion 229 which primarily serve to retain the terminal in place within the housing 201.

The first set of terminals 221 are inserted into a plurality of slots that are formed in the top wall 212 of the housing 201 which include openings that communicate with the mating slot 210 and are positioned so that the contact portions 225 of the first set of terminals 221 may at least partially extend into the mating slot 210. The second set of terminals 222 are inserted into a plurality of slots that are formed in the bottom wall 213 of the housing 201 which include openings that communicate with the mating slot 210 and are positioned so that the contact portions 225 of the second set of terminals 222 may at least partially extend into the mating slot 210.

In one embodiment of the present invention, there is at least one solder bracket 300 coupled to the housing 201 of the connector 200. With reference to FIGS. 5A, 5B, 5C and 5D, the solder bracket 300 may further comprise a bracket body 320 having a first side 304 with a thickness t1, a second side 305 with a thickness t2 and a bridge portion 302 with a thickness tb connecting the first side 304 to the second side 305; and a plurality of solder contact portions 310 extending from the first side 304 and the second side 305 of the bracket body 320.

Preferably, the first side 304 and the second side 305 further comprise a plurality of locking devices 330 and/or a plurality of support tabs 340 extending from the first side 304 and/or the second side 305 contiguous to the board-mounting end 208. The locking device 330 may include, but is not limited to, a hook 333 wherein preferably, there is a plurality of engagement barbs 335 coupled to at least one edge of the hook 333. The engagement barbs 335 anchor the solder bracket 300 to the housing 201 as the hook 333 latches on the housing 201 thereby preventing the solder bracket 300 from disengaging from the housing 201.

Figure 5A:
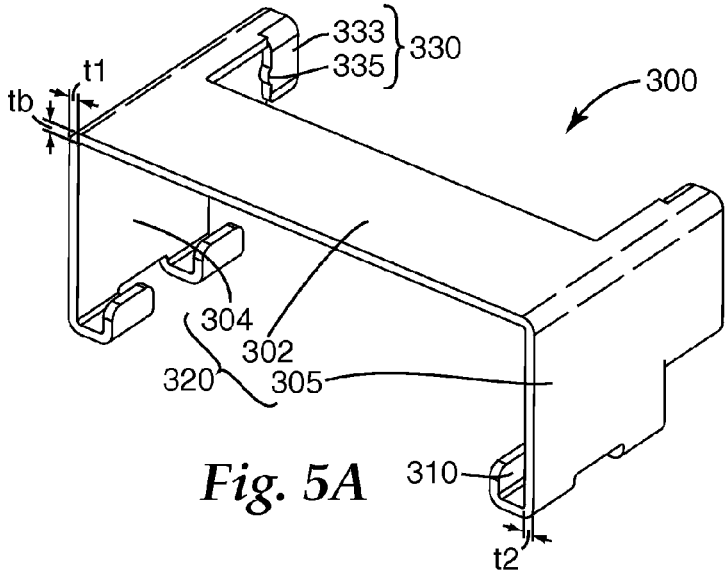
FIG. 5A shows the perspective shape of the solder bracket removed from the exemplary connector of FIG. 3B.
Figure 5B:
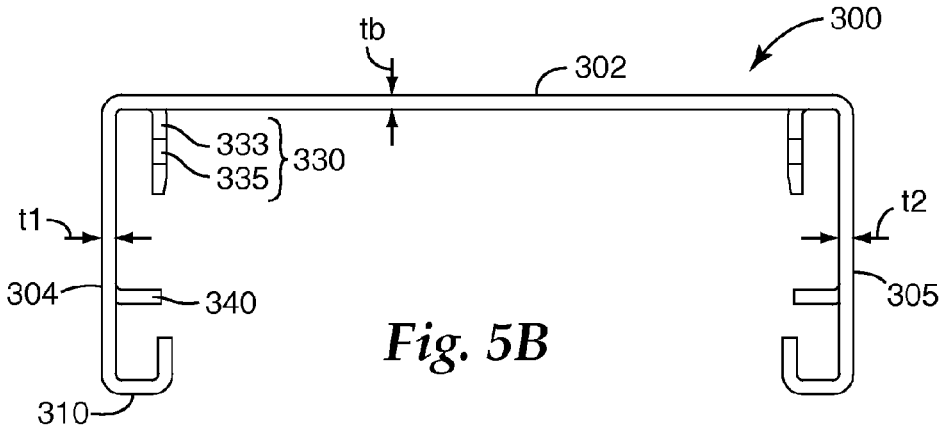
FIG. 5B shows the front view of the solder bracket of FIG. 5A.
Figure 5C:
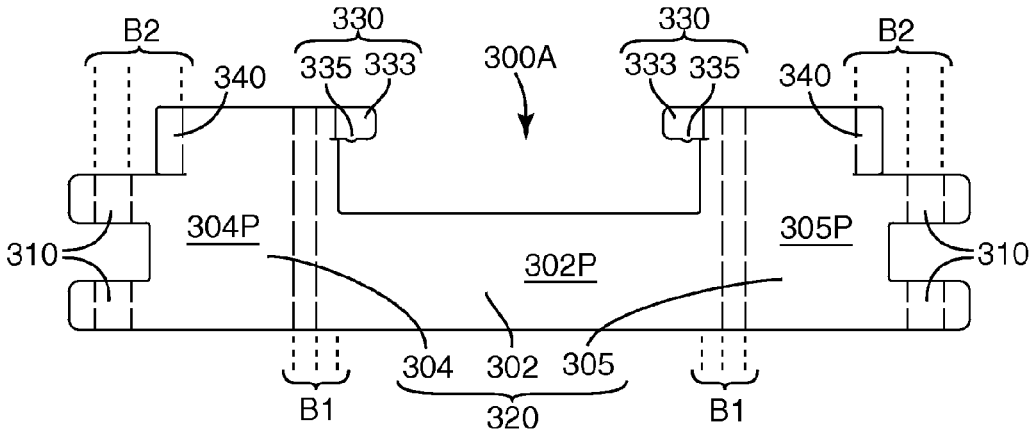
FIG. 5C is a schematic perspective view showing an exemplary intermediate for fabricating the solder bracket of FIG. 5A.
Figure 5D:
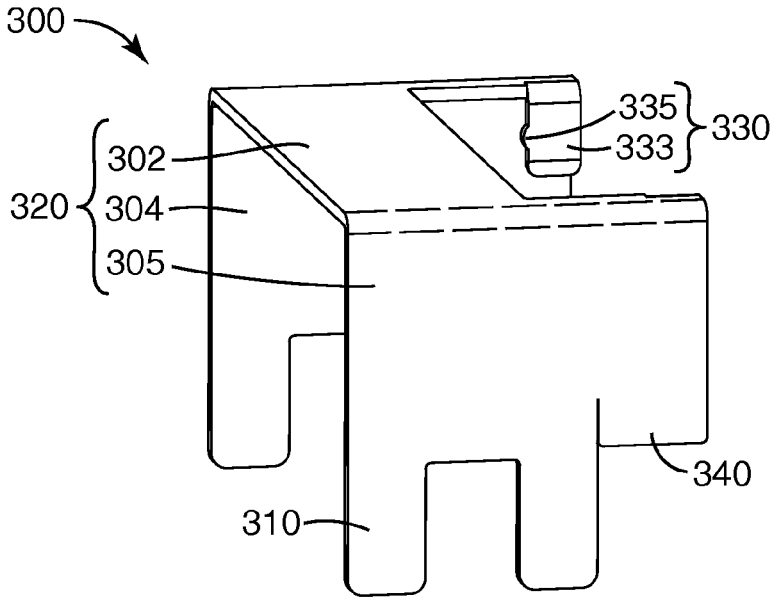
FIG. 5D shows the perspective shape of the solder bracket of FIG. 5A after it has been bent prior to fitting on the housing of the exemplary connector of FIG. 3B.

The solder bracket 300 may be made of an intermediate 300A such as shown in FIG. 5C, which is prepared by the steps of blanking a piece of metal sheet by means of a press, and bending it at required portions into shape. In FIG. 5C, portions 304P, 302P and 305P define the first side 304, the bridge portion 302 and the second side 305 respectively. A plurality of solder contact portions 310, locking devices 330 and/or support tabs 340 are defined on the intermediate 300A. The intermediate 330A is bent along the bend lines B1 using known methods such as with a stamping die to give the initial shape of the solder bracket 300 as shown in FIG. 5D before the solder bracket 300 is coupled to the housing 201. FIGS. 5A and 5B illustrate the final shape of the solder bracket 300 after the solder bracket 300 is coupled to the housing 201 and bent along the bend lines B2 using known methods such as with a bending jig. It should be noted that the above process description is just one of the ways of producing and coupling the solder bracket 300 to the housing 201 and that the solder bracket 300 may also be assembled, bent and coupled to the housing 201 using other methods including manual, semi-automated and automated processes.

Figure 6:
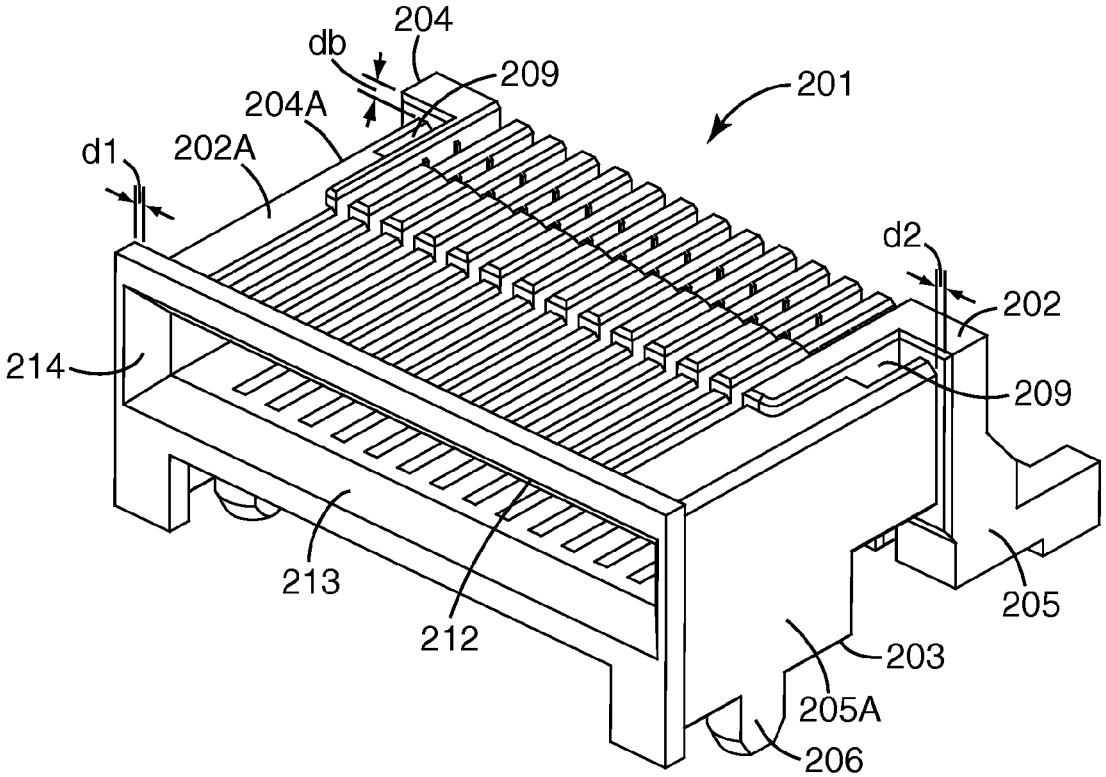
FIG. 6 shows a perspective view of the housing of the exemplary connector of FIG. 3B.

Referring to FIG. 6, in one embodiment of the present invention, there is at least one recessed portion 202A at the top 202, at least one recessed portion 204A at the first side 204 and at least one recessed portion 205A at the second side 205 of the housing 201. Preferably, the recessed portion 202A has a depth db equal or more than the thickness tb of the bridge portion 302, the recessed portion 204A has a depth d1 equal or more than the thickness t1 of the first side 304 and the recessed portion 205A has a depth d2 equal or more than the thickness t2 of the second side 305 of the solder bracket 300.

When a solder bracket 300 with thickness t1, t2 and tb is coupled to a connector housing 201 with recesses of respective depths d1, d2 and db, the outer surfaces of the first side 304, the second side 305 and the bridge portion 302 of the solder bracket 300 will be on the same plane as the outer surfaces of the first side 204, the second side 205 and the top 202 of the connector housing 201 if t1 is equal to d1, t2 is equal to d2 and tb is equal to db. If the outer surfaces of the first side 304, the second side 305 and the bridge portion 302 of the solder bracket 300 are on the same plane as the outer surfaces of the first side 204, the second side 205 and the top 202 of the connector housing 201, the external profile of the connector 200 remains unchanged after the solder bracket 300 is coupled to the housing 201 and therefore the exemplary connector 200 will be able to mate with existing plug connectors 10 without any modification.

When a solder bracket 300 with thickness t1, t2 and tb is coupled to a connector housing 201 with recesses of respective depths d1, d2 and db, the outer surfaces of the first side 304, the second side 305 and the bridge portion 302 of the solder bracket 300 will be at a lower plane than the outer surfaces of the first side 204, the second side 205 and the top 202 of the connector housing 201 if t1<d1, t2<d2 and tb<db. If the outer surfaces of the first side 304, the second side 305 and the bridge portion 302 of the solder bracket 300 are at a lower plane than the outer surfaces of the first side 204, the second side 205 and the top 202 of the connector housing 201, in addition to the solder bracket 300 being fixed in its position within the recess thereby limiting the lateral movement of the solder bracket 300 relative to the housing 201, existing plug connectors 10 are also able to mate with the connector 200 without any modification.

In one embodiment of the present invention, the housing 201 further comprises a plurality of grooves 209 at the recessed portions 204A and 205A of the first side 204 and the second side 205 of the housing 201 contiguous to the board-mounting end 208. The grooves 209 may either extend from the top 202 to the bottom 203 of the housing 201 or may extend from either the top 202 or the bottom 203 and terminating midway into the housing 201. As illustrated in FIG. 3B, in one embodiment of the present invention, the locking devices 330 may hang over the top edges of the recessed portions 204A and 205A of the first side 204 and the second side 205 before terminating in the grooves 209.

Figure 7A:
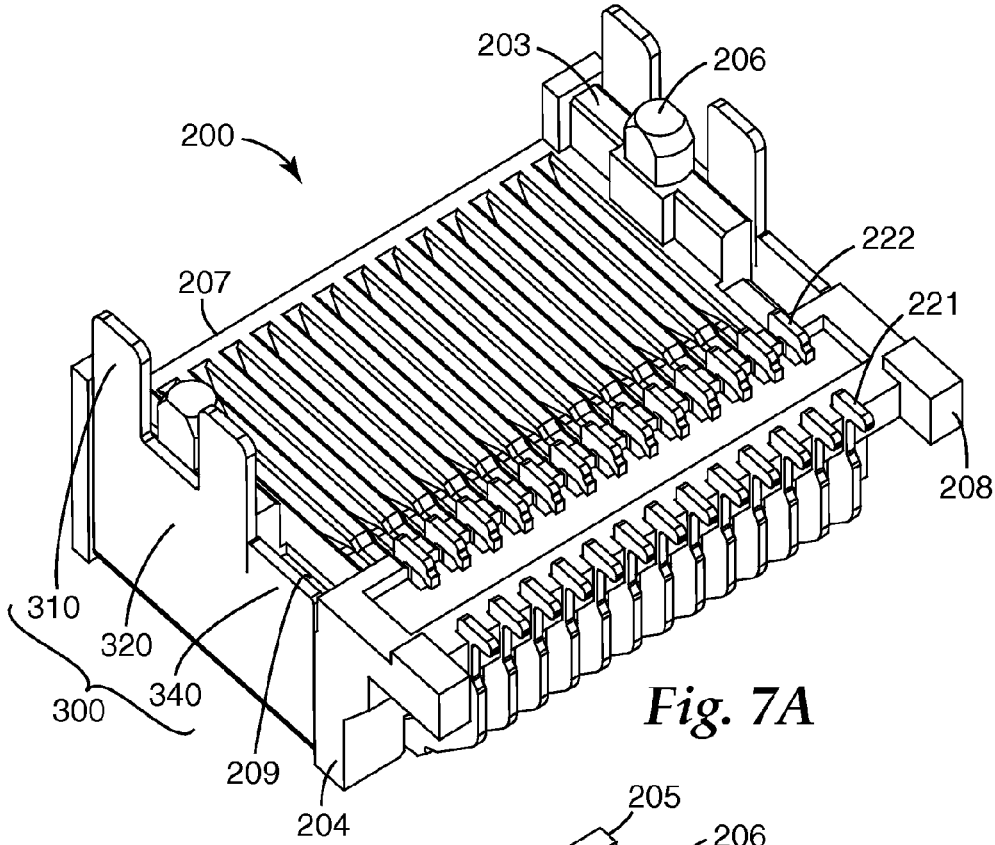
FIG. 7A is a bottom view of the housing of the exemplary connector of FIG. 3B with a solder bracket placed in the recess of the housing awaiting to be fitted.
Figure 7B:
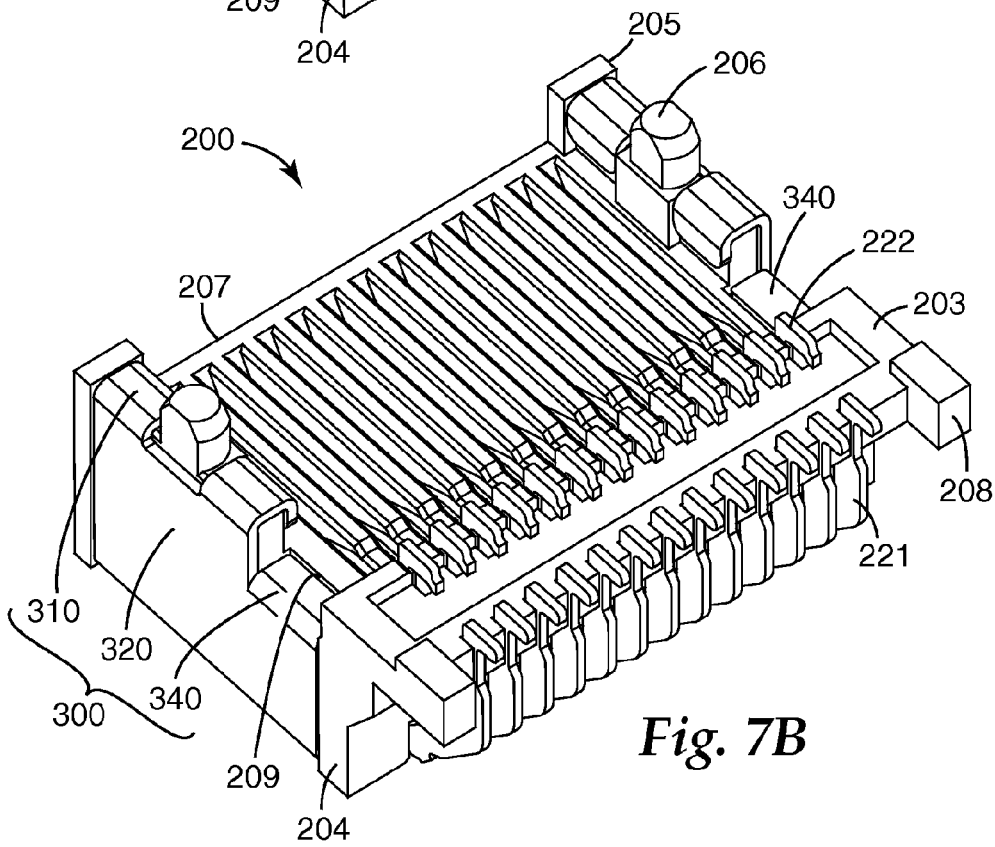
FIG. 7B is a bottom view of the housing of the exemplary connector of FIG. 3B with the solder bracket fitted in the recess of the housing.

FIG. 7A is a bottom view of the exemplary connector 200 with the solder bracket 300 of FIG. 5D coupled to the housing 201. FIG. 7B is a bottom view of the exemplary connector 200 with the solder contact portions 310 and the support tabs 340 of the solder bracket 300 bent along the bend lines B2 after the solder bracket 300 is coupled to the housing 201. FIG. 5A shows the perspective view and 5B shows the front view of the solder bracket 300 when the solder bracket 300 in FIG. 7B is decoupled from the housing 201.

In this embodiment, the solder bracket 300 is further held in place relative to the connector housing 201 by the hooks 333, the engagement barbs 335 (both the hooks 333 and the engagement barbs 335 are not shown in FIGS. 7A and 7B but represented in FIGS. 5A and 5B), the bending of support tabs 340 and solder contact portions 310 around the bottom edges of the recessed portions 204A and 205A of the first side 204 and the second side 205 of the housing 201.

Figure 8A:
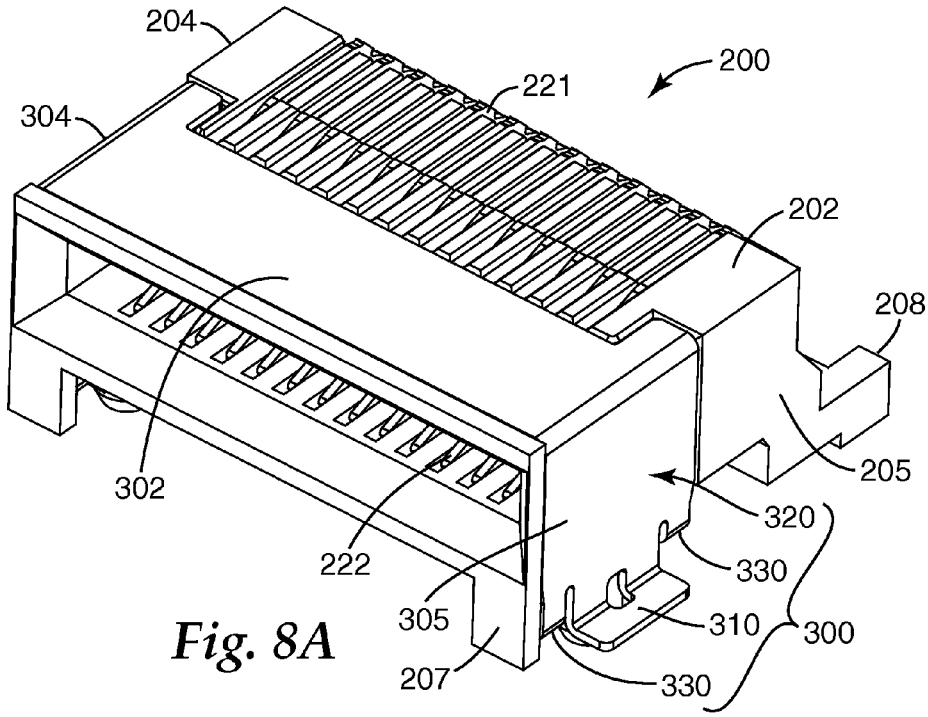
FIG. 8A is a perspective view of another exemplary connector.
Figure 8B:
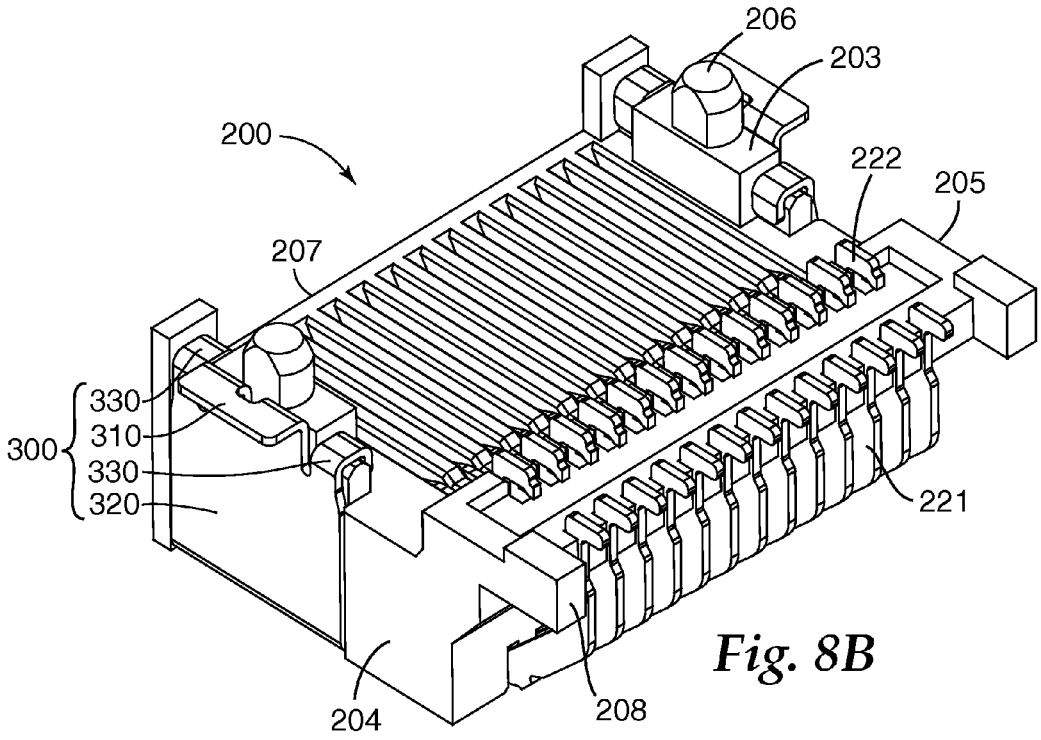
FIG. 8B is a bottom view of the exemplary connector of FIG. 8A.

FIGS. 8A and 8B illustrate another embodiment of the present invention wherein a plurality of solder contact portions 310 are bent away from the housing 201 and a plurality of locking devices 330 are bent to hook around the bottom edges of the recessed portions 204A and 205A of the first side 204 and the second side 205 of the housing 201. This embodiment provides additional real estate for soldering the connector 200 to the PCB 4.

Figure 9A:
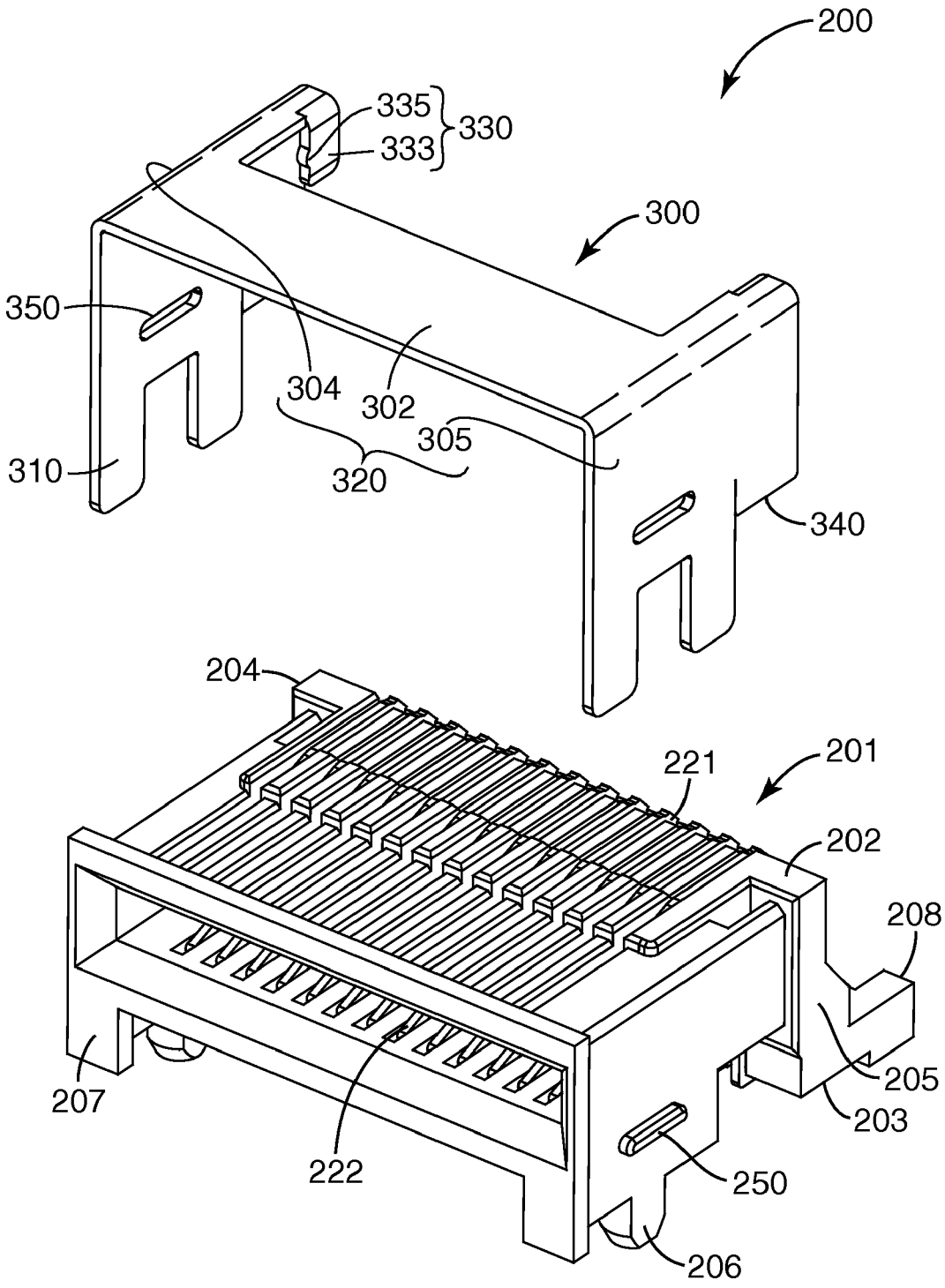
FIG. 9A is an exploded perspective view of another exemplary connector.
Figure 9B:
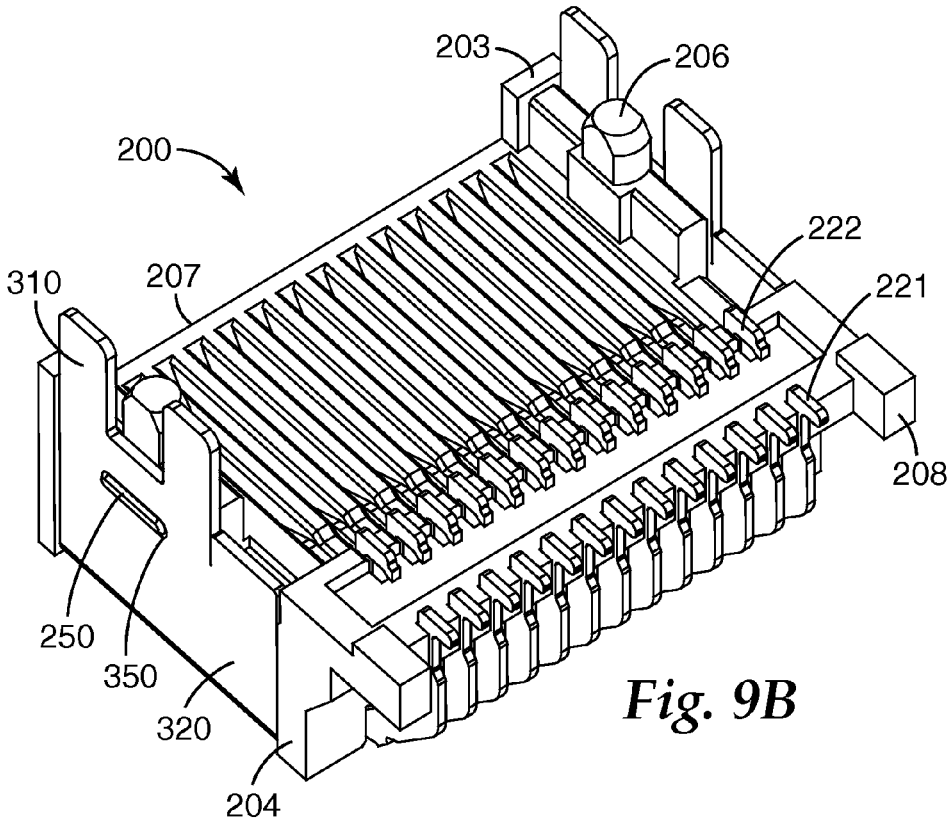
FIG. 9B is a bottom view of the exemplary connector of FIG. 9A wherein the solder bracket is coupled to the housing.
Figure 9C:
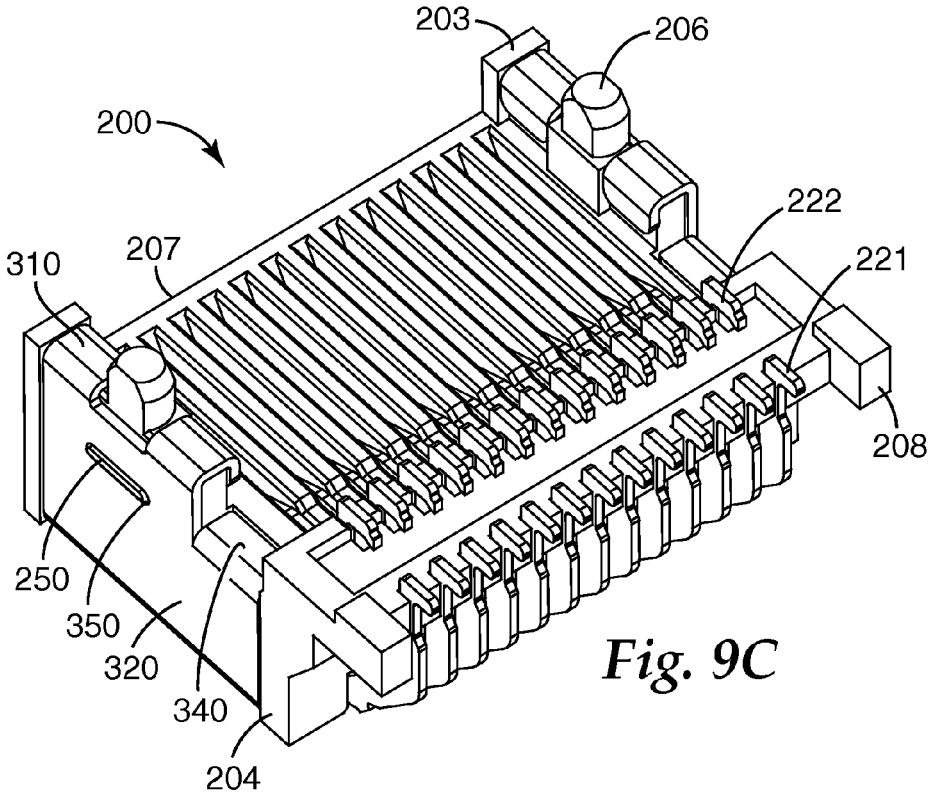
FIG. 9C is a bottom view of the exemplary connector of FIG. 9A wherein the solder bracket is coupled to the housing and bent along a plurality of predefined bend lines.

FIGS. 9A, 9B and 9C illustrate another embodiment of the present invention wherein the connector 200 further comprises a plurality of latching devices 350 on the solder bracket 300 and a plurality of engagement portions 250 on the housing 201 of the connector 200. When the solder bracket 300 is coupled to the housing 201, the latching devices 350 latches to the engagement portions 250 thereby further keeping the solder bracket 300 secured to the housing 201 of the connector 200.

The foregoing description of the preferred embodiment of the invention has been presented for purposes of illustration and description. It is not intended to be exhaustive or to limit the invention to the precise forms disclosed, since many modifications or variations thereof are possible in light of the above teaching. All such modifications and variations are within the scope of the invention. The embodiments described herein were chosen and described in order to best explain the principles of the invention and its practical application, thereby to enable others skilled in the art to utilise the invention in various embodiments and with various modifications as are suited to the particular use contemplated thereof. It is intended that the scope of the invention be defined by the claims appended hereto, when interpreted in accordance with the full breadth to which they are legally and equitably suited.

The invention claimed is:

1. An electrical connector comprising:

an insulative housing that has a top wall, a bottom wall, a first side, a second side wherein all four sides are connected to form a mating face and a board-mounting end;

a plurality of terminals supported in the housing and terminating at the board-mounting end, wherein the terminals are grouped into a first set inserted into the housing through openings in the top wall of the housing and a second set inserted into the housing through openings in the bottom wall of the housing, and wherein each terminal further comprises a contact portion configured to establish electrical contact with a complementary mating connector, a solder tail that extends out of the housing at the board-mounting end, a body portion that is disposed intermediate the contact portion and the solder tail and which interconnect them together; and at least one solder bracket coupled to the housing wherein a major portion of the solder bracket lies within the profile of the housing.

2. The electrical connector of claim 1 wherein the housing further comprises a plurality of mounting posts at the bottom of the housing.

3. The electrical connector of claim 1 or claim 2 wherein the housing further comprises at least one recessed portion with depth of d1 at the first side, at least one recessed portion with depth of db at the top, and at least one recessed portion with depth of d2 at the second side of the housing.

4. The electrical connector of claim 3 wherein the housing further comprises a plurality of grooves at the recessed portions of the first side and the second side of the housing.

5. The electrical connector of claim 1 wherein the solder bracket further comprises:

a bracket body having a first side of thickness t1, a second side of thickness t2 and a bridge portion of thickness tb connecting the first side to the second side, optionally including a plurality of locking devices extending from at least one side of the bracket body, which locking device may comprise a hook with a plurality of engagement barbs coupled to at least one edge of the hook; and a plurality of solder contact portions extending from the first side and the second side of the bracket body.

6. The electrical connector of claim 5 wherein the solder bracket further comprises a plurality of support tabs extending from at least one side of the bracket body.

7. The electrical connector of claim 5 wherein thickness t1 is less than recess depth d1 or thickness t2 is less than recess depth d2 or thickness tb is less than recess depth db.

8. The electrical connector of claim 5 wherein thickness t1 is equal to the recess depth d1 or thickness t2 is equal to the recess depth d2 or thickness tb is equal to the recess depth db.

9. The electrical connector of claim 1 wherein the housing further comprises a plurality of engagement portions and the solder bracket further comprises a plurality of latching devices configured to latch on the engagement portions on the housing.

10. An electrical connector comprising:

an insulative housing that has a top wall, a bottom wall, a first side, a second side, all four sides connected to form a mating face and a board-mounting end wherein at the mating face, there is at least one mating slot extending into the housing;

a plurality of terminals supported in the housing and terminating at the board-mounting end wherein the terminals are grouped into a first set inserted into the housing through openings in the top wall of the housing and a second set inserted into the housing through openings in the bottom wall of the housing, and each terminal in the first set and the second set further comprises a contact portion that extends into the mating slot, a solder tail that extends out of the housing at the board-mounting end, a body portion that is disposed intermediate the contact portion and the solder tail and which interconnect them together; and at least one solder bracket coupled to the housing wherein a major portion of the solder bracket lies within the profile of the housing.

* * * * *